United States Patent [19]

Baatrup

[11] 4,145,167

[45] Mar. 20, 1979

[54] GEROTOR MACHINE WITH PRESSURE BALANCING RECESSES IN INNER GEAR

[75] Inventor: Johannes V. Baatrup, Sonderborg, Denmark

[73] Assignee: Danfoss A/S, Denmark

[21] Appl. No.: 884,175

[22] Filed: Mar. 6, 1978

Related U.S. Application Data

[63] Continuation of Ser. No. 767,058, Feb. 9, 1977, abandoned.

[30] Foreign Application Priority Data

Feb. 17, 1976 [DE] Fed. Rep. of Germany ..... 2606172

[51] Int. Cl.[2] ..... F03C 3/00; F04C 1/02; F04C 15/00

[52] U.S. Cl. ..... 418/61 B; 418/77; 418/142; 418/186

[58] Field of Search ..... 418/61 B, 77, 79, 142, 418/186

[56] References Cited

U.S. PATENT DOCUMENTS

| | | | |
|---|---|---|---|
| 2,940,399 | 6/1960 | Zieg et al. | 418/77 |
| 3,120,190 | 2/1964 | Schmitter et al. | 418/144 |
| 3,171,590 | 3/1965 | Bentele et al. | 418/142 |
| 3,233,524 | 2/1966 | Charlson | 418/61 B |
| 3,506,275 | 4/1970 | Moriyama | 418/142 |
| 3,775,031 | 11/1973 | Hansen | 418/61 B |
| 3,876,343 | 4/1975 | Giversen | 418/61 B |
| 3,894,821 | 7/1975 | White, Jr. | 418/142 |

*Primary Examiner*—John J. Vrablik
*Attorney, Agent, or Firm*—Wayne B. Easton

[57] ABSTRACT

The invention relates to a rotary type piston machine of the type having inner and outer relatively rotatable and orbital ring and wheel gears and a pivotal drive shaft connected to the wheel gear. The casing forms sidewalls for the gears and leakage between the wheel gear and the sidewalls is a chronic problem. The wheel gear on the side opposite from the drive shaft is provided with an annular groove and a sealing ring therein to provide sealing between the inner gear element and the adjacent sidewall. The shaft side of the wheel gear has recessed areas in the crests of the teeth thereof to provide pressure compensation for the effect of the sealing the above referred to sealing ring on the opposite side thereof.

1 Claim, 4 Drawing Figures

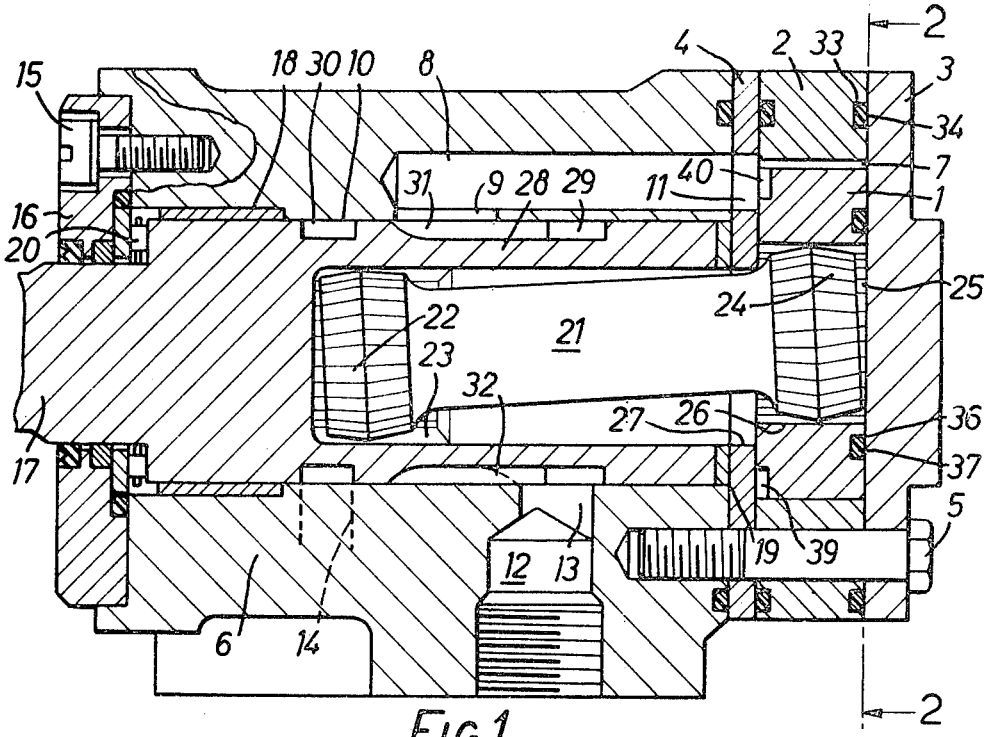
FIG. 1
FIG. 2
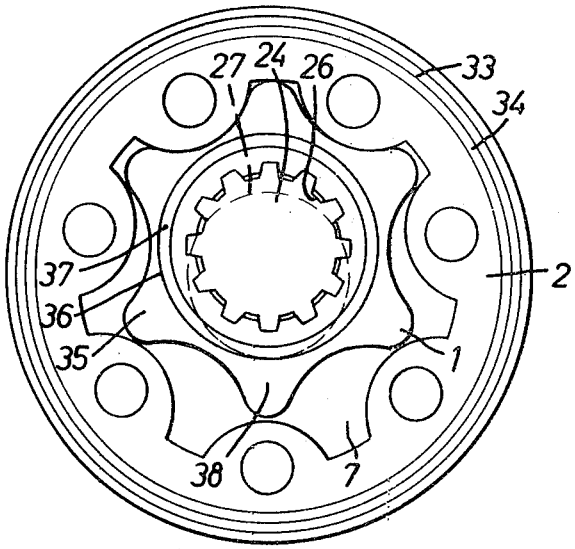
FIG. 3
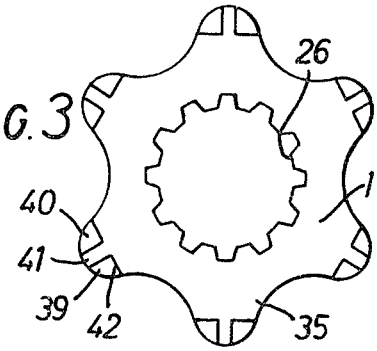
FIG. 4
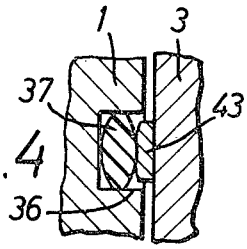

GEROTOR MACHINE WITH PRESSURE BALANCING RECESSES IN INNER GEAR

This is a continuation patent application of Ser. No. 767,058 which was filed Feb. 9, 1977 now abandoned.

The invention relates to a rotary piston machine for liquids, comprising a gear wheel and a gear ring which encloses same, forms compression chambers therewith and has one additional tooth, a pivot shaft engaging the gear wheel, and two end walls disposed on both sides of the gear elements, one end wall having a central aperture for the passage of the pivot shaft but the other being continuous at least in this region.

Such machines are known as motors, pumps or flow meters. They are used as a drive for vehicles and machines, in hydrostatic steering units and for many other applications.

In such rotary piston machines, the spacing between the two end walls must be selected so that the gear can turn without considerable friction losses. This leads to a gap causing leakage losses to be formed between the gear and the adjoining end walls. In addition, the aperture in the end wall is comparatively large because, to transmit the desired power, the shank of the pivot shaft must have a certain cross-section and the aperture must be appropriately larger to take into account the gyratory motion of the pivot shaft. However, this means that, if a permissible amount of leakage losses is not to be exceeded, the diameter of the gear wheel has to be chosen to be so large that the length of the sealing gap on the side of the aperture does not become too small, this necessitating a correspondingly large gear ring and being in conflict with the engineering requirements of building machines that are as small as possible. Excessively large leakage losses, however, lead to a higher slip. This is particularly detrimental in rotary piston machines for control and steering units because the displacement prescribed at the steering wheel is not proportionally transmitted to the wheels and there must be continuous further control even during rectilinear travel with a lateral load on the wheels. With given radial dimensions for the machine, the narrower the width of the gear wheel, the more disruptive are these leakage losses because the leakage losses amount to a higher percentage of the total quantity.

The invention is based on the problem of providing a rotary piston machine of the aforementioned kind in which the radial dimensions can be kept small without exceeding the permissible leakage losses.

This problem is solved by the invention in that a sealing ring is disposed between the gear wheel and the continuous end wall in an annular groove.

This suggestion recognises the fact that on the side that is predominantly subjected to leakage losses, namely along the end wall having the aperture, a reduction in the gear wheel diameter necessarily leads to an increase in the leakage losses. However, this is compensated by the fact that on the opposite side there is practically complete sealing of the gap by using a sealing ring. In this way it is possible to reduce the total leakage losses or to keep the dimensions of the gear wheel and thus of the entire machine very small in relation to the aperture for the pivot shaft, without exceeding a predetermined amount of leakage oil. For example, in a hydraulic machine with pressures of about 100 bar, a respective minimum spacing between the aperture and the root of the tooth of the gear wheel of about 1.5 mm will be sufficient.

With particular advantage, the annular groove is provided in the gear wheel. Even when the space between the root of the tooth and the aperture for receiving the head of the pivot shaft is small, it suffices to accommodate the annular groove. The area of the continuous end wall swept by the annular groove during the gyratory and rotary motion of the gear wheel may be considerably larger.

Whereas it is generally conventional for such machines to provide sealing rings between two components that are fixed to each other, the gear wheel moves relatively to the continuous end wall. Such relative motion does not, however, damage the sealing ring because it is comparatively small. In any case, special provisions may be made to take the relative motion into account.

In particular, the sealing ring may consist of polytetrafluoroethylene. This material has two concurrent advantageous properties. It is easily deformable in the cold state and therefore has good sealing properties. In addition, it has a good slidability in relation to metal.

It is also possible to cover the sealing ring in the annular groove by a metallic annular disc which is fixed with respect to the sealing ring and reduces the friction relatively to the adjoining metal wall.

Since there is no longer a leakage flow on one side of the gear wheel by reason of the sealing means, there is also no pressure drop between the pressurised compression chambers and the unpressurised interior of the gear wheel. Instead, the pressure is fully effective on the one side of the gear wheel outside the sealing ring. This could possibly lead to the gear wheel being pressed against the apertured end wall with such a large force that frictional losses are created. This can be counteracted in a simple manner in that on the side of the gear wheel opposite the sealing ring there are pressure compensating areas which bound compensating chambers connected to the compression chambers. These pressure compensating areas can readily be selected so that the pressure variations arising as a result of the sealing ring are substantially compensated.

It is of particular advantage if the compensating chambers are formed by depressions in the gear wheel. This is particularly so if the annular groove is also provided in the gear wheel because in that case the respective areas can be accurately adapted to one another.

In one preferred embodiment, provision is made for each tooth crest to be provided over part of its height with two-depressions separated by a radial web. The provision of the depressions at the tooth crest permits comparatively large pressure compensating areas to be achieved without thereby shortening the sealing gap between the root of the tooth and the aperture. The radial web ensures that non-adjacent compression chambers are short-circuited.

If there is a primary distributing valve having a first portion which is connected to the gear wheel by way of the pivot shaft and has first control apertures and a second portion which is connected to the gear ring, is connected to the compression chambers by way of passages and has second control apertures controllable by the first control apertures, the depressions on the tooth crest may be dimensioned so that they form a secondary distributing valve with the gear ring.

The invention will now be described in more detail with reference to the example illustrated in the drawing, wherein:

FIG. 1 is a longitudinal section through a rotary piston machine according to the invention;

FIG. 2 is a sectional view taken on line 2—2 of FIG. 1;

FIG. 3 is a plan view of the gear wheel from the opposite side, and

FIG. 4 is a sectional view of a modified form of the seal.

The machine of FIG. 1 comprises a gear wheel 1 and a gear ring 2 co-operating therewith. These components are covered on the one side by a first end wall 3 formed by a cover and on the other side by a second end wall 4 formed by an intermediate plate. The end wall 3, gear ring 2 and end wall 4 are connected to each other and to a housing 6 by screws 5. Compression chambers 7 are formed between the gear wheel 1 and gear ring 2 and the end walls 3 and 4. In the housing there are connecting passages 8 which connect respective control apertures 9 at the inner periphery 10 of the housing 6, which forms a part of a distributing valve, to passages 11 in the end wall 4, which passages in turn communicate with the compression chambers 7. In addition, connections 12 are provided in the housing that likewise lead to the inner peripheral wall 10 by way of passages 13 or 14 but are axially displaced with respect to the control aperture 9. A closure plate 16 is applied to the free end of the housing by means of screws 15.

A main shaft 17 is radially mounted in a slide bearing 18 and between a bearing plate 19 and an axial bearing 20 held by the plate 16. A pivot shaft 21 has a toothed head 22 engaging with teeth 23 of the main shaft and another toothed head 24 engaging with teeth 25 provided in a central aperture 26 of the gear wheel 1. The shank of the pivot shaft 21 is passed through an aperture 27 in the end wall 4.

The main shaft 17 is in the form of a rotary slide 28 having two annular grooves 29 and 30 communicating with the connecting passages 13 and 14. From these circumferential grooves there alternately extend control apertures 31 and 32 which are formed by axial grooves and the number of which is twice the number of teeth on the gear wheel 1, whilst the number of control apertures 9 is equal to the number of teeth on the gear ring 2. Consequently the compression chambers 7 formed between the gear wheel 1 and the gear ring 2 having one additional tooth are filled with and emptied of liquid in the correct sequence. The rotary slide 28 and the inner periphery 10 of the housing therefore operate as a distributing valve in the conventional manner. An O-ring 34 of rubber is disposed in an annular groove 33 between two parts that are fixed with respect to the housing, e.g. the gear wheel 2 and the end wall 3.

In one side wall of the gear ring 1, an annular groove 36 is provided between the aperture 26 and the tooth 35 of the gear wheel 1, a sealing ring 37 of polytetrafluoroethylene being disposed in the annular groove. This sealing ring substantially completely seals the gap between the gear wheel 1 and the end wall 3. The leakage loss is therefore restricted to the gap between the gear wheel 1 and the second end wall 4, which has a differing length over the circumference. In FIG. 2, the aperture 27 is shown in broken lines. The shortest gap is obtained in the illustrated position of the gear wheel 1 between the roots to both sides of the lowermost tooth 35 and the aperture 27. However, since a leakage path is eliminated between the gear wheel 1 and the end wall 3, the gear wheel 1 can have a small circumference so that the shortest length of gap between the gear wheel 1 and intermediate wall 4 only amounts to e.g. 1.5 mm without the danger of an excessive leakage loss.

Since the sealing ring 37 prevents leakage flow, a pressure can build up outside of the sealing ring in the region 38, which pressure is equal to the pressure in the adjacent compression chambers 7. If this should cause the gear wheel 1 to be pressed excessively strongly against the end wall 4, each tooth 35 may receive two depressions 39, 40 on the side opposite the sealing ring 37, the depressions being separated from one another by a radial web 41. This results in pressure compensating areas 42 in which the pressure of the adjacent compression chambers 7 likewise obtains. These depressions can in addition be dimensioned so that, together with the gear wheel 2, they form a secondary distributing valve downstream of the primary distributing valve 10, 28. By way of these depressions, adjacent compression chambers can be kept in communication with one another until one tooth crest of the gear wheel 2 makes contact either with one tooth root or with one tooth crest in the region of the web 41 of the gear wheel 1. This permits substantial compensation of inaccuracies in the operation of the first distributing valve.

FIG. 4 illustrates a modification in which the sealing ring 37 in the annular groove 36 is covered by an annular plate 43 of metal. This annular plate 43 remains stationary relatively to the sealing ring 37 but results in little friction in relation to the end wall 3.

Many modifications of this construction are possible. For example, the rotary slide 28 may be of disc form instead of cylindrical. Also, the end wall 4 may serve directly as a distributing plate.

I claim:

1. A rotary piston machine comprising, a casing, radially inner and outer relatively rotatable and orbitable wheel and ring gears which form compression chambers therebetween, said ring gear being in fixed relation to said casing, said wheel gear having inner and outer parallel surfaces, said casing forming inner and outer axially spaced sidewalls for said gears with said inner sidewall having a central aperture, a pivot shaft extending through said aperture and engaging said wheel gear, said wheel gear and said casing outer sidewall having mutually engaging surfaces, an annular groove formed in said wheel gear outer surface, a sealing ring in said outer groove forming a primary pressure area between said casing outer sidewall and the portion of said wheel gear radially outward from said sealing ring, said wheel gear having teeth with the crest of each tooth having a pair of pressure balancing recesses in said wheel gear inner surface with a symmetrically arranged radially extending rib dividing each pair of recesses, said recesses being dimensioned to form a plurality of secondary pressure areas on said wheel gear to collectively offset the opposite effects of said primary pressure area.

* * * * *